United States Patent [19]

Benedikt et al.

[11] Patent Number: 4,870,319

[45] Date of Patent: Sep. 26, 1989

[54] SPARK PLUG WITH CREEPAGE SPARK GAP

[75] Inventors: Walter Benedikt, Kornwestheim; Werner Herden, Gerlingen; Jürgen Schmatz, Mundelsheim; Siegbert Schwab, Sindelfingen, all of Fed. Rep. of Germany

[73] Assignee: Robert Bosch GmbH, Stuttgart, Fed. Rep. of Germany

[21] Appl. No.: 155,717

[22] PCT Filed: May 6, 1987

[86] PCT No.: PCT/DE87/00202

§ 371 Date: Jan. 13, 1988

§ 102(e) Date: Jan. 13, 1988

[87] PCT Pub. No.: WO87/07094

PCT Pub. Date: Nov. 19, 1987

[30] Foreign Application Priority Data

May 16, 1986 [DE] Fed. Rep. of Germany ..... 3616668

[51] Int. Cl.[4] ..... H01T 13/20

[52] U.S. Cl. ..... 313/137; 313/130; 313/143; 123/169 CA

[58] Field of Search ..... 313/130, 131 R, 131 A, 313/137, 141–145; 315/59; 123/169 CA, 169 E, 169 P

[56] References Cited

U.S. PATENT DOCUMENTS

| | | | |
|---|---|---|---|
| 2,592,754 | 4/1952 | Smits | 123/169 |
| 3,295,005 | 12/1966 | Poellet et al. | 313/141 |
| 4,439,707 | 3/1984 | Hattori et al. | 313/130 |
| 4,476,412 | 10/1984 | Nishida et al. | 313/130 |
| 4,631,451 | 12/1986 | Anderson et al. | 313/130 |
| 4,695,758 | 9/1987 | Nishida et al. | 313/130 |

FOREIGN PATENT DOCUMENTS

| | | |
|---|---|---|
| 3533123 | 3/1987 | Fed. Rep. of Germany . |
| 2188333 | 1/1974 | France . |
| 2063363 | 6/1981 | United Kingdom . |

*Primary Examiner*—Ulysses Weldon
*Assistant Examiner*—Michael Horabik
*Attorney, Agent, or Firm*—Michael J. Striker

[57] ABSTRACT

A spark plug with creepage spark gap for internal combustion engines includes a plug housing having an annular side electrode, an insulator, surrounded by the plug housing over a longitudinal section, and a central electrode. The layer lies in a through-bore of the insulator and is exposed on the combustion chamber end side. The creepage spark gap is formed between the central electrode and the side electrode along a slideway on the surface of the insulator. To achieve a small plug capacitance with high-dielectric slideway, the insulator has, at least at the end section on the combustion chamber side, at least two coaxial material layers, having very different dielectric constants. These coaxial layers lie or partially lie against each other in a radial direction of the spark plug.

3 Claims, 3 Drawing Sheets

SPARK PLUG WITH CREEPAGE SPARK GAP

BACKGROUND OF THE INVENTION

The invention relates to a spark plug with creepage spark gap for internal combustion engines.

Such spark plugs with creepage spark gap, which is formed on the surface of the insulator, on the combustion chamber side, between the central electrode and the side electrode, are distinguished by a much lower ignition voltage compared with a spark plug with spark gap in air. It has been found in this respect that the firing voltage is all the lower the greater the di-electric constant of the material of the insulator. However, such an insulator of high-dielectric material results in a spark plug of a relatively high capacitance, which causes a disruptive discharge at the creepage spark gap. Due to the very hot spark, of several ten thousand degrees, produced upon disruptive discharge, the surfaces of the electrodes and, in particular, the slideway of the creepage spark gap are greatly eroded, as a result of which the proper function of the spark plug and its service life are in turn considerably impaired.

In the case of a known spark plug of the type stated at the start (German Patent Application No. P 35 33 123.2), to avoid the breakdown phase with high energy, the insulator is divided transversly in the end region on the combustion chamber side and the larger-volume upper part on the connection side is made of a material having a low-dielectric constant and the smaller-volume lower part on the combustion chamber side is made of a material having a very much higher dielectric constant. However, the total capacitance of the spark plug cannot be kept small enough, so that the energy in occasionally occurring breakdown phases does after all cause notable erosion in the insulator surface.

SUMMARY OF THE INVENTION

It is an object of the present invention to provide a

The spark plug according which has the advantage that, due to the coaxial laminar structure of the insulator or plug insulating body, a coaxial capacitor with layered dielectric is produced, the total capacitance of which is determined by the smaller capacitance of the low-dielectric layer, which is the layer having a very much smaller dielectric constant. Therefore, ceramics having a relative dielectric constant of up to 10,000 can be used in the high-dielectric layer without increasing the plug capacitance, if only the low-dielectric layer has a relatively small dielectric constant of approximately 10 to 50.

With the provision of an advantageously high-dielectric slideway, the spark plug according to the invention has an only small plug capacitance and consequently exhibits only slight erosion effects on the slideway. The high dielectric constant of the insulator surface, on which the slideway is formed, makes the ignition voltage requirement of the spark plug low, so that a considerable part of the energy made available by the ignition system is transferred to the fuel mixture. As a result, good inflammation conditions are created even for lean fuel mixtures. The low ignition voltage requirement gives rise to all the advantages of a low-voltage ignition, such as smaller ignition coil, good suppression effect, low expenditure on high-voltage insulation.

Using materials having a very high relative dielectric constant, for example between 500 and 10,000, a low ignition voltage is achieved even with relatively thin layers, the layer thickness of which is between 0.1 and 1 mm. Such layers may be applied by plasma spraying to a plug insulating body of, for example, aluminum oxide. Using this technique, several layers of material having high dielectric constants can be applied one on top of the other, it being possible for the dielectric constant of the individual layers to increase in stages or continuously. It is sufficient in this respect to apply the high-dielectric layer or layers only in the slideway region and otherwise to produce the plug insulating body or insulator completely from aluminum oxide ceramic, without isolating points.

The overlapping of the layers in axial direction may be provided, which achieves a high voltage strength between the layers in axial direction, an overlapping extending into the slideway region keeping the high voltage stress of the high-dielectric layer small.

The annular insulating discs make the radial annular isolating points between the layers sealed off against high voltages.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTI0N OF THE PREFERRED EMBODIMENTS

Figure 1:
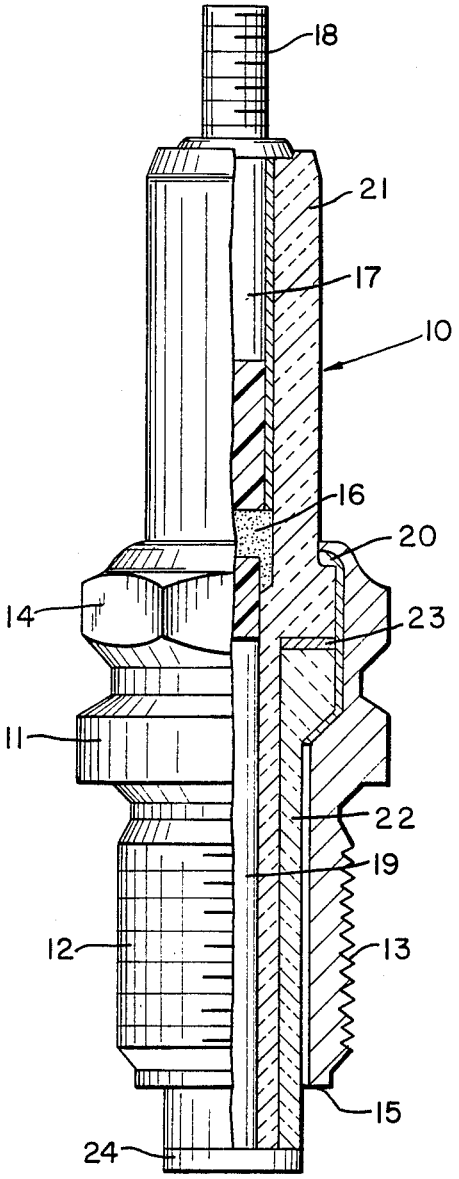
FIGS. 1 to 6 each show a spark plug, half in side view and half in longitudinal section according to six different embodiments of the invention.

As shown in the drawings, the spark plugs for internal combustion engines, all have an insulator 10, which is surrounded over a longitudinal section by a metallic plug housing 11. The plug housing 11 bears an external thread 13 on an end section 12 of reduced diameter, by means of which external thread the spark plug is screwed into cylinder head (not shown) of the internal combustion engine. A wrench hexagon 14 is used in a known way for screwing in. The end section 12 forms an annular electrode 15 on its end face protruding into the combustion chamber of the internal combustion engine.

The rotationally symmetrical insulator 10, having a central axial through-bore 16, projects on both sides of the plug housing 11 out of the latter. Within the through-bore 16, a metallic connection bolt 17 is arranged, which bears on its end section remote from the combustion chamber, a connection piece 18 for the electrical connection of the spark plug to the ignition system. In the lower region of the through-bore there is a central electrode 19 which rest on the face of the insulator 10 on the combustion chamber side. The connection bolt 17 and the central electrode 19 are conductively connected to each other by an enamel flow compound 20.

In the case of all spark plugs according to FIGS. 1 to 6, the insulator 10 has, at least in the end section on the combustion chamber side, two coaxial material layers, having very different dielectric constants, lying completely or partially against each other in radial direction. The relative dielectric constant of one of the materials used here lies between 10 and 50, and of the other material between 5,000 and 10,000. The materials used in the two material layers are in this case paired in such a way that the difference between their dielectric constants is as great as possible.

Figure 2:
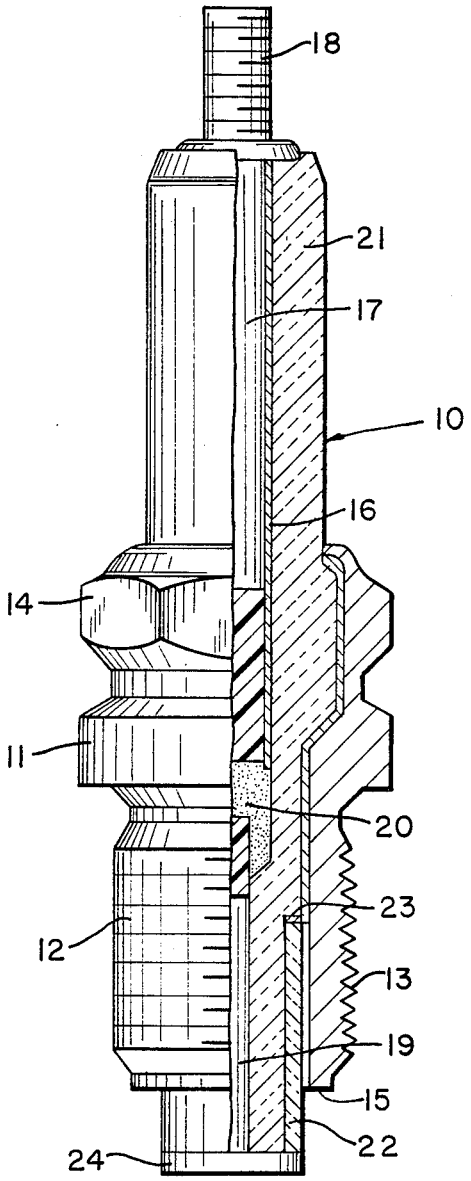

In the case of the spark plugs in FIGS. 1 and 2, the insulator 10 essentially comprises a fully continuous basic element 21 of aluminum oxide ceramic having a relatively small dielectric constant (less than 15), and a sleeve 22 of a high-dielectric material, for example barium titanium oxide ($Ba_2TiO_3$), having a relatively high dielectric constant of approximately 5,000. Sleeve 22 is pushed on from the end of the basic element 21 on the combustion chamber side. For receiving the sleeve 22, the basic element 21 is of reduced diameter over an end section on the combustion chamber side. In the case of the spark plug of FIG. 1, the sleeve 22 extends from the face end of the basic element 21 over virtually the entire embracing region of the plug housing 11, while in FIG. 1, the sleeve 22 only covers the basic element 21 in the end of the simulator 10 on the combustion chamber side, and terminates approximately in the middle of the end section 12 of the plug housing 11. The annular face of the sleeve 22 remote from the combustion chamber is covered by a radially projecting shoulder of the basic element 21. At this radial isolating point between basic element 21 and sleeve 22, is inserted a high-voltage resistant annular insulating disc 23 of silicone or epoxy resin. The faces of basic element 21 and sleeve 22 on the combustion chamber side are covered by an end cap 24, which is made of the same material as the central electrode 19 and is conductively connected to the latter.

When using materials having a very high relative dielectric constant, a low ignition voltage is achieved even with relatively thin layers of 0.1 to 1 mm. In this case, it is possible to dispense with the sleeve 22 and apply the high-dielectric layer directly onto the insulator 10 of aluminum oxide ceramic, for example by plasma spraying. With this technique, it is also possible to apply several layers, one on top of the other, with a continuous or staged transition of the dielectric constants between the ceramic and final high-dielectric layer (for example, barium titanium oxide). It is also possible here to provide the high-dielectric layer or layers exclusively in the slideway region of the insulator 10 between end cap 24 of the central electrode 19 and the electrode 15.

Figure 3:
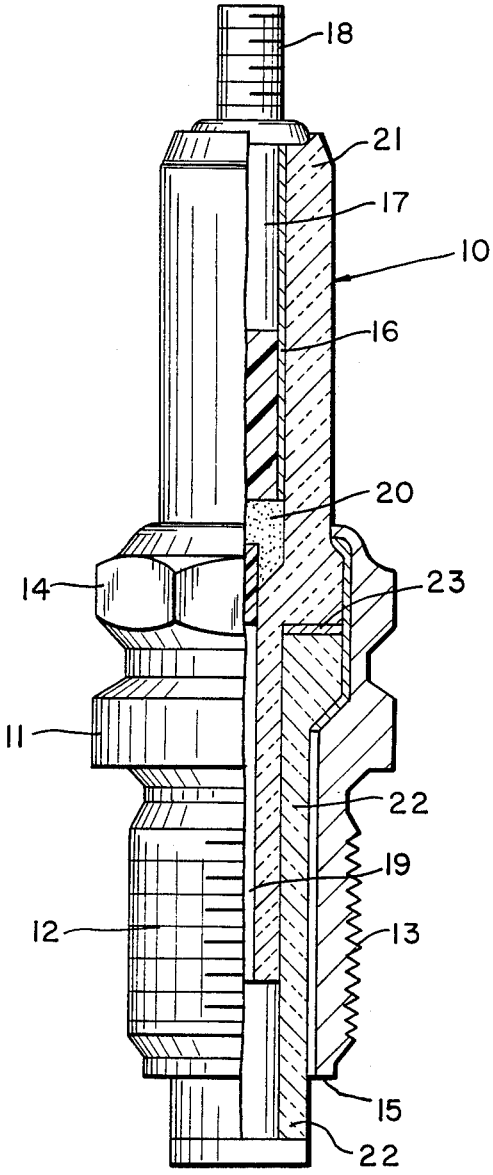
Figure 4:
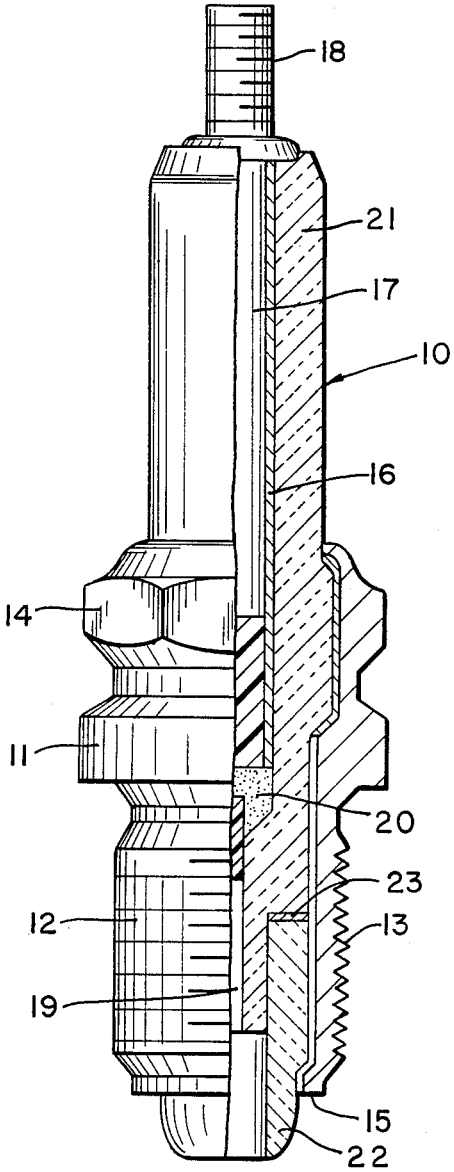

In the case of the spark plugs illustrated in FIGS. 3 and 4, the basic element 21 and the sleeve 22 do not run coaxially with respect to each other up to the end face of the insulator 10 on the combustion chamber side, but overlap only partially in the axial direction, the basic element 21 terminating at a distance ahead of the end face of the insulator 10 on the combustion chamber side, within the embracing region of the plug housing 11, while the sleeve 22 reaches as far as the free end. At the exit point from the through-bore 16 running in the basic element 21, the central electrode 19 is widened as far as the sleeve 22, so that the sleeve 22 directly surrounds engages the central electrode 19 over a longitudinal section of the basic element 21 and over an adjoining further longitudinal section toward the combustion chamber. While in the case of the spark plug in FIG. 3, the sleeve 22 extends far into the plug housing 11 and does not terminate until close to the wrench hexagon 14, in the case of the spark plug in FIG. 4, the sleeve already terminates in the end section 12 of the plug housing 11. The annular face of the sleeve 22 is exposed in FIG. 4, while in FIG. 3 it is again covered by the end cap 24 connected to the central electrode 19.

Figure 5:
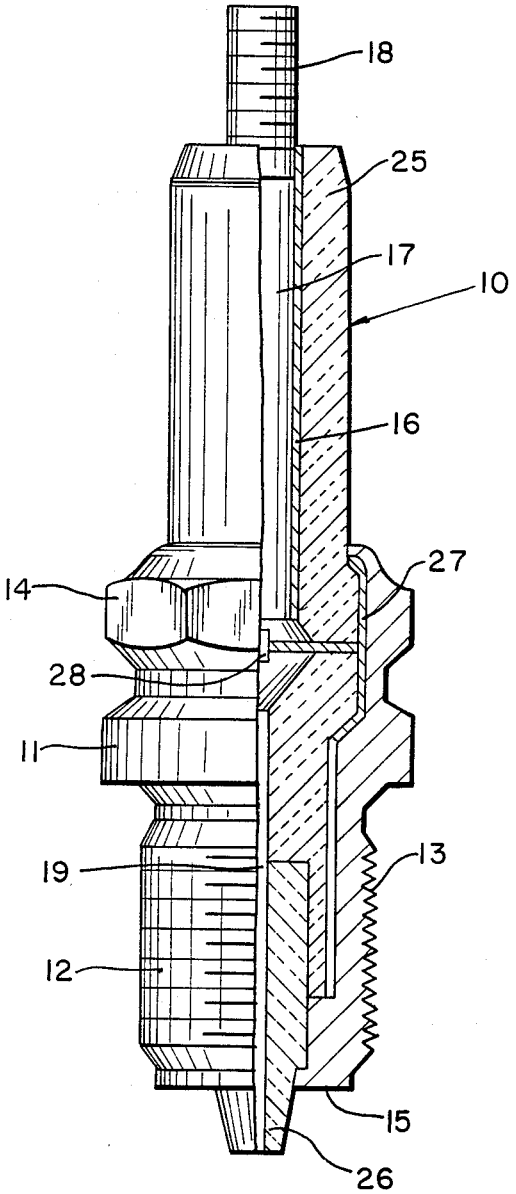
Figure 6:
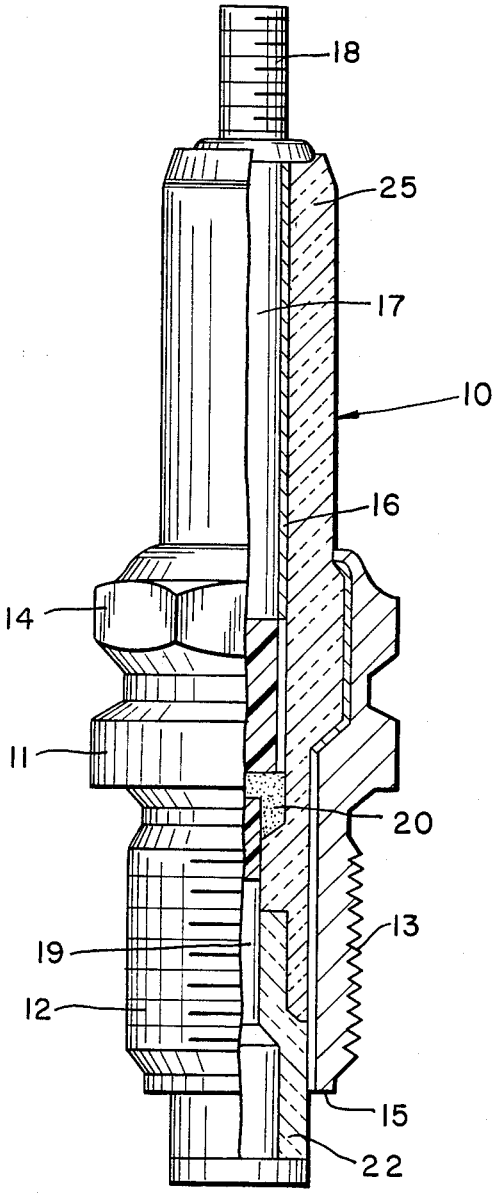

In the case of the spark plugs in FIGS. 5 and 6, the insulator 10 again has a basic element 25 of aluminum oxide ceramic, which contains the through-bore 16 and terminates inside the metallic plug housing 11. The through-bore is of a widened diameter at a distance from the end of the basic element 25 on the combustion chamber side. A hollow peg 26 of high-dielectric material is pushed into this cylindrical ring consequently remaining between the central electrode 19 and the basic element 25, so that said hollow peg, surrounds and engages the end region of the central electrode 19 and is partially surrounded and engaged by a longitudinal section of the basic element 25.

In the case of the spark plug in FIG. 5, the central electrode 19 and the connection bolt 17 are not connected to each other by an enamel flow compound, but are separated from each other by a highly insulating separating layer 27, which is pierced by a contact pin 28 for the electrically conductive connection of connection bolt 17 and central electrode 19.

Unlike FIG. 5, in FIG. 6 the central electrode 19 is designed in the end region of the combustion chamber side similarly to the case of the spark plug of FIG. 3. The diameter of the central electrode 19 is again enlarged at the end section on the combustion chamber side. The hollow peg 26 is designed here in the manner of a funnel and again surrounds the central electrode 19 up to its end on the combustion chamber side. Its outer circumference is flush with the outer circumference of the basic element 25. At the face end on the combustion chamber side, the hollow peg 26 is again covered with the end cap 24 connected to the central electrode 19.

It will be understood that each of the elements described above, or two or more together, may also find a useful application in other types of spark plugs differing from the types described above.

While the invention has been illustrated and described as embodied in a spark plug, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A spark plug with a creepage spark gap for use in internal combustion engines, comprising a tubular housing which includes a housing section protruding into a combustion chamber of the internal combustion engine and having at an end face thereof protruding into the combustion chamber an annular electrode, an insulator which has a through-bore and is surrounded by the housing over a longitudinal section thereof and projects beyond the housing on the combustion chamber side, and a central electrode which is positioned in the through-bore in the insulator and has an end exposed on the combustion chamber side, the creepage spark gap being formed between the central electrode and the annular electrode along a slideway on a surface of the insulator, the insulator including, at least at an end section thereof on the combustion chamber side, at least two coaxial material layers lying at least partially against each other in radial direction of the spark plug, one of said layers having a relatively low dielectric constant in the order of tens, and the other layer having a relatively high dielectric constant in the order of thousands, said two layers run coaxially to each other up to an end face of the insulator on the combustion chamber side, said one layer of a low dielectric constant surrounds the central electrode and is surrounded by said other layer of a high dielectric constant over a longitudinal section reaching up to the end face of the insulator.

2. A spark plug according to claim 1, wherein said one layer of a low dielectric constant is integrally made with the insulator of the same material and said other layer of a high dielectric constant is applied on the insulator.

3. A spark plug with a creepage spark gap for use in internal combustion engines, comprising a tubular housing which includes a housing secton protruding into a combustion chamber of the internal combustion engine and having at an end face thereof protruding into the combustion chamber an annular electrode, an insulator which has a through-bore and is surrounded by the housing over a longitudinal section thereof and projects beyond the housing on the combustion chamber side, and a central electrode which is positioned in the through-bore in the insulator and has an end exposed on the combustion chamber side, the creepage spark gap being formed between the central electrode and the annular electrode along a slideway on a surface of the insulator, the insulator including, at least at an end section thereof on the combustion chamber side, at least two coaxial material layers lying at least partially against each other in radial direction of the spark plug, one of said layers having a relatively low dielectric constant in the order of tens, and the other layer having a relatively high dielectric constant in the order of thousands, said two material layers overlapping each other in an axial direction of the spark plug and only the other layer of a high dielectric constant projects outwardly from the housing at an end thereof on the combustion chamber side, said other layer surround said one layer of a low dielectric constant and surrounds the central electrode at an end section thereof projecting outwardly from the housing.

* * * * *